US005435293A

United States Patent [19]

Grimaldi

[11] Patent Number: 5,435,293

[45] Date of Patent: Jul. 25, 1995

[54] EYE SHIELD TO ASSIST A PERSON IN SHOOTING WITH BOTH EYES OPEN

[76] Inventor: Thomas J. Grimaldi, 36 Cordes Dr., Tonawanda, N.Y. 14150

[21] Appl. No.: 757,728

[22] Filed: Sep. 11, 1991

[51] Int. Cl.[6] ..... F41B 5/14; F41G 1/467

[52] U.S. Cl. ..... 124/87; 124/86; 33/265

[58] Field of Search ..... 124/23.1, 24.1, 86, 124/87, 88; 33/233, 244, 265, 252, 261; 42/100

[56] References Cited

U.S. PATENT DOCUMENTS

| | | | |
|---|---|---|---|
| 2,855,680 | 10/1958 | Christensen | 33/233 |
| 2,927,375 | 3/1960 | Luebkeman | 33/233 |
| 3,923,035 | 12/1975 | Trotter | 124/24.1 |
| 4,162,579 | 7/1979 | James | 33/265 |
| 4,343,286 | 8/1982 | Thacker | 124/24.1 |
| 4,542,591 | 9/1985 | Montgomery | 33/265 |
| 4,689,887 | 9/1987 | Colvin | 33/265 |
| 4,918,823 | 4/1990 | Santiago | 33/233 X |
| 5,022,378 | 6/1991 | Rhodehouse et al. | 124/44.5 |

*Primary Examiner*—Randolph A. Reese
*Assistant Examiner*—John Ricci
*Attorney, Agent, or Firm*—Phillips, Lytle, Hitchcock, Blaine & Huber

[57] ABSTRACT

An eye shield (20) for a bow includes a horizontally-elongated plate-like member (51) operatively mounted on the bow, and preferably to a sight (32) mounted thereon. The member extends toward the head of a person aiming the bow, and, if projected rearwardly, would intersect such person at a point between his eyes. The sight is so dimensioned, configured and arranged as to limit the field of vision of each of such person's eyes, to assist the person in shooting the bow with binocular vision.

13 Claims, 2 Drawing Sheets

Fig. 1.
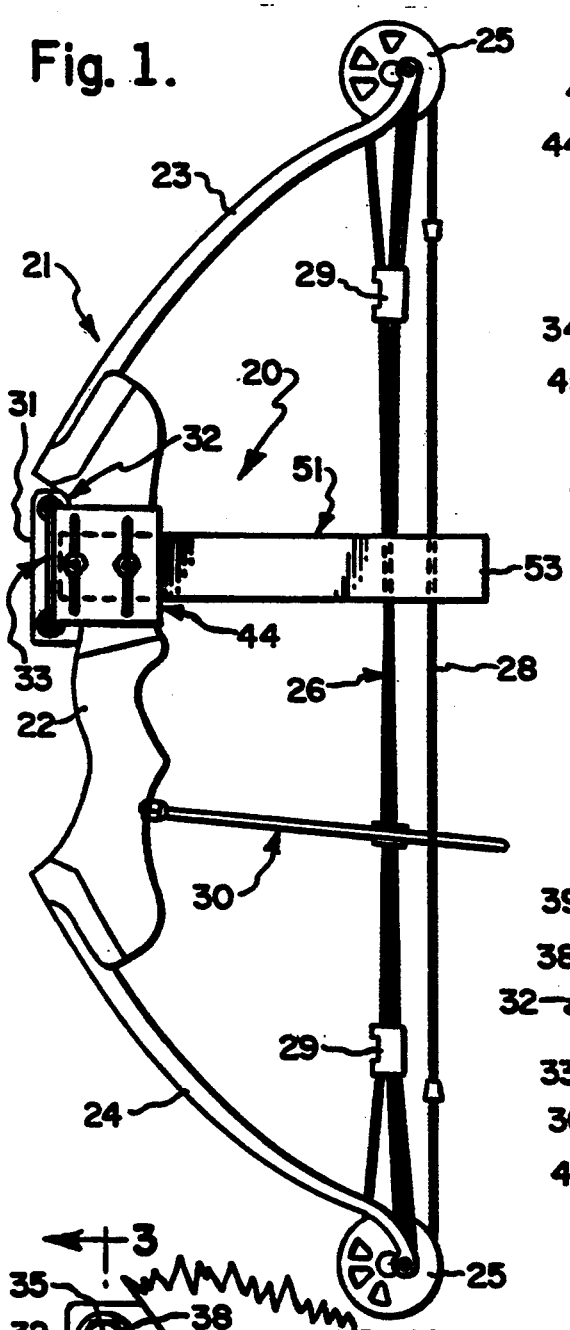
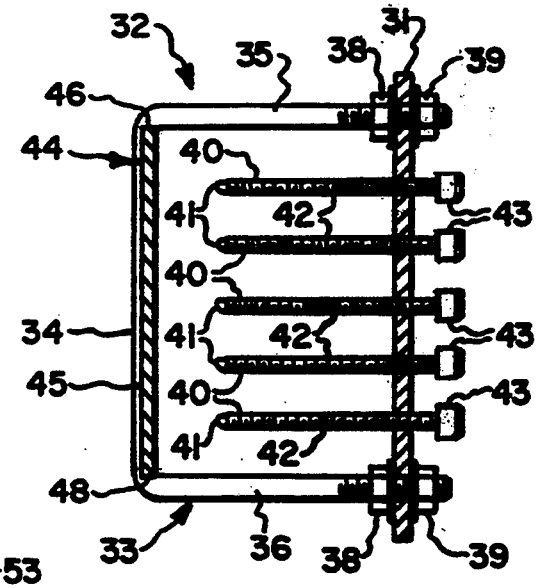
Fig. 3.
Fig. 4.
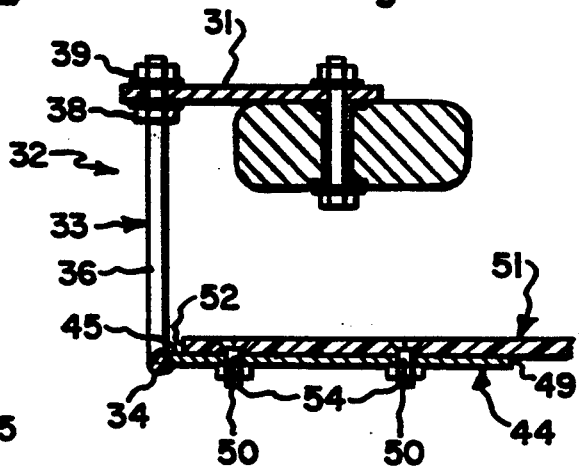
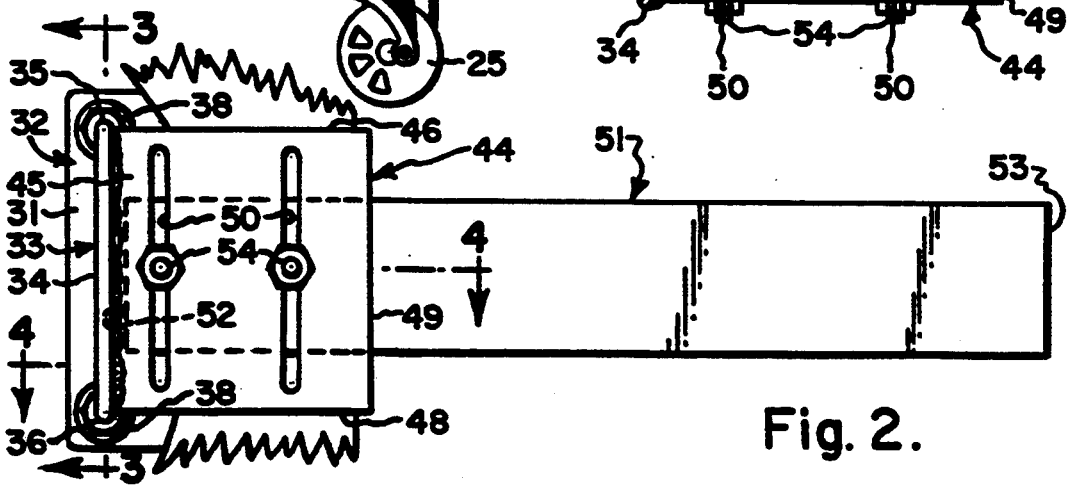
Fig. 2.

EYE SHIELD TO ASSIST A PERSON IN SHOOTING WITH BOTH EYES OPEN

TECHNICAL FIELD

The present invention relates generally to the fields of archery and firearms, and, more particularly, to an improved eye shield to assist a person in shooting with both eyes open.

BACKGROUND ART

Many people have learned to shoot by closing one eye, while sighting or aiming the weapon with the other.

In recent years, however, this somewhat-traditional method of sighting or aiming has been revisited, particularly among hunters. An article by Dean Phillips, entitled "Eyes of a Champion", published in the June, 1990 issue of Bowhunting World reviews the question of shooting with monocular vision (i.e., with one eye closed), as opposed to the advantages of shooting with binocular vision (i.e., with both eyes open). This article asserts that one eye may be dominant over the other. The article further counsels that with moving targets, or in low-light conditions, there are distinct advantages to shooting with both eyes open.

For those who have learned to shoot with one eye closed, the problem of relearning binocular vision is somewhat difficult. Being a creature of habit, a person who has learned to shot with one eye closed may experience some difficulty in relearning how to shoot in order to have the advantages of binocular vision.

Accordingly, it would be generally desirable to provide a device which may be readily attached to a bow or firearm, and which will facilitate a person's transition from monocular to binocular vision while shooting. At the same time, it would be desirable to provide a device to facilitate shooting with binocular vision for those persons who have learned this skill.

DISCLOSURE OF THE INVENTION

With parenthetical reference to the corresponding parts, portions or surfaces of the disclosed embodiment, for purposes of illustration but without limitation, this invention provides an improved eye shield (e.g., 20) which is adapted to be attached to a bow (e.g., 21) for assisting a person in shooting an arrow from the bow with both eyes open. The improved eye shield broadly includes: a plate-like member (e.g., 51) having a forward marginal end portion. (e.g., 52) mounted on the bow or a device (e.g., a sight) attached to the bow, and having a rearward marginal end portion (e.g., 53) extending rearwardly therefrom toward the person's head when such person normally aims the bow. The member, if imaginarily projected rearwardly, would intersect the person's head at a point between his eyes while aiming the bow. The member is so dimensioned, proportioned and arranged as to limit the field of vision of each of such person's eyes; whereby the eye shield will assist the archer in shooting with both eyes open.

In another aspect, the invention provides an improved eye shield which is adapted to be attached to a firearm (e.g., a rifle, a handgun, etc.) to assist a person in shooting that firearm with both eyes open. In this case, the improved eye shield comprises: a plate-like member (e.g., 62) having a forward marginal end portion and a rearward marginal end portion the member being mounted on the firearm such that, when the person normally aims that firearm, the plate, if projected rearwardly, would intersect the person's head at a point between his eyes, the member being so dimensioned, proportioned and arranged as to limit the field of vision of each of the person's eyes; whereby the member will assist the person in shooting the firearm with both eyes open.

Accordingly, the general object of the invention is to provide an improved eye shield which is adapted to be mounted on a bow or firearm to assist a person in shooting that weapon with both eyes open.

Another object is to provide an improved eye shield which is adapted to be mounted on a bow or firearm, to assist a person in learning to shoot that weapon using binocular, rather than monocular, vision.

Still another object is to provide an improved eye shield for use on a bow or firearm, which is relatively inexpensive, which may be readily attached to the weapon, and which does not interfere with the normal use of that weapon.

These and other objects and advantages will become apparent from the foregoing and ongoing written specification, the drawings, and the appended claims.

BRIEF DESCRIPTION OF THE DRAWINGS

FIG. 1 is a side elevation of a compound bow, shown as being vertically arranged, upon which the improved eye shield is mounted.

FIG. 2 is an enlarged fragmentary detail view of the eye shield shown in FIG. 1.

FIG. 3 is a fragmentary transverse vertical sectional view thereof, taken generally on line 3—3 of FIG. 2, and shows the plate as being mounted on a bar-type bow sight.

FIG. 4 is a fragmentary longitudinal horizontal sectional view thereof, taken generally on line 4—4 of FIG. 2.

DESCRIPTION OF THE PREFERRED EMBODIMENT(S)

Figure 5:
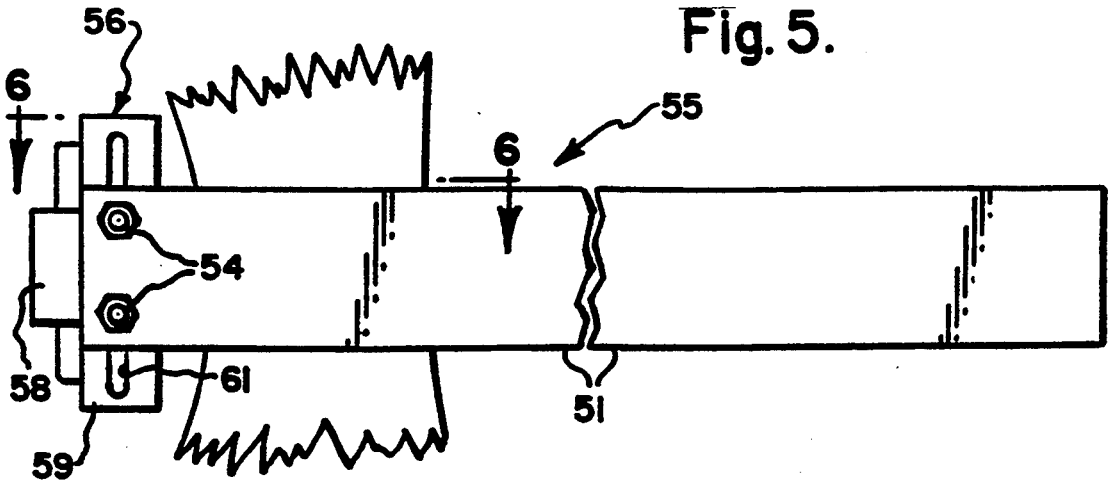
FIG. 5 is a view, generally similar to FIG. 2, showing the improved eye shield as being mounted on a box-type bow sight.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

First Embodiment (FIGS. 1–4)

Referring now to the drawings, and, more particularly, to FIGS. 1–4 thereof, a first form of the improved eye shield, generally indicated at 20, is shown as being operatively mounted on a compound bow, generally indicated at 21. This bow is shown as having a central riser or handle portion 22 from which a pair of upper and lower flexible limbs 23,24 extend outwardly. Wheels, severally indicated at 25, are operatively mounted on the distal marginal end portions of limbs 23,24. A cable, generally indicated at 26 is wrapped around the wheels and engages the bow, to provide a draw string 28. Cable 26 is shown as being further provided with two torque stabilizers, severally indicated at 29. Another stabilizer, generally indicated at 30, is mounted on the handle, and extends rearwardly therefrom to capture a portion of the cable. A mounting plate 31 is suitably secured to the reverse surface of the handle portion. In this first form, a bar-type bow sight, generally indicated at 32 is operatively mounted on plate 31.

As best shown in FIG. 3, sight 32 includes a protective U-bolt, generally indicated at 33. This U-bolt is shown as having a vertical cross-bar 34 and integral upper and lower horizontal leg portions 35,36 extending rightwardly therefrom. The marginal end portions of these legs are threaded, and the U-bolt is secured to the mounting plate by means of nuts 38,39.

Sight 32 further includes a plurality of sight pins, severally indicated at 40. These in the illustrated form, there are five of such sight pins, although a greater or lesser number could be alternatively employed. Each sight pin 40 is shown as having a leftwardmost tip 41, which may be of a fluorescent or some other highly-visible material, a threaded shank portion 42 matingly received in tapped holes provided through the mounting plate 31, and a rightwardmost knurled knob 43 which is adapted to be grasped and selectively rotated. Thus, each sight pin may be individually rotated so as to vary the horizontal position of the tip 41 relative to the mounting plate. Other means (not shown) may be provided to vary the vertical position of the pins relative to the bow. For example, the mounting plate may be provided with a slot to enable it to be selectively moved relative to the bow.

In this first embodiment, a first plate-like member, generally indicated at 44, is suitably secured to the sight. In the illustrated form, member 44 is shown as being a vertically-disposed rectangular plate having a leftward or forward marginal end portion 45 suitably welded to the vertical leg 34 of U-bolt 33. More particularly, and as best shown in FIG. 2, plate 44 has an upper horizontal surface 46, a lower horizontal surface 48, and a rightward or rearward vertical surface 49. The plate is provided with two horizontally-spaced vertical slots, severally indicated at 50.

The eye shield, generally indicated at 51, is shown as being a second horizon, tally-elongated plate-like member having a leftward or forward marginal end portion 52, and having a rightward or rearward marginal end portion 53. In the preferred embodiment, the horizontal length of shield 51 may be on the order of 12 inches, and its vertical height may be on the order of about 2 inches. In any event, it is presently preferred that the length-to-height ratio of shield 51 should be at least 5. Shield 51 is attached to overlapped plate 44 by a plurality of fasteners, severally indicated at 54. These fasteners penetrate suitable holes provided through shield 51, and have their threaded shank portions passed through slots 50. The fasteners further include nuts, which may be selectively loosened or tightened. Thus, the eye shield is mounted for vertical movement relative to plate 44. Once in the desired position, the nuts of fasteners 54 may be suitably tightened to hold the shield in a desired position relative to plate 44.

The eye shield thus extends rearwardly from the handle portion of the bow toward a person aiming the same. More particularly, the rear marginal end portion 53 of the shield extends beyond draw string 28, when the bow is in an unflexed condition (as shown in FIG. 1 ). The eye shield, if projected rearwardly, would intersect a person aiming the bow at a point between his eyes. Thus, the eye shield is so dimensioned, configured and arranged as to limit the field of vision of each of such person's eyes, while aiming the bow. This will assist the archer in learning to shoot with binocular as opposed to monocular vision.

Figure 6:
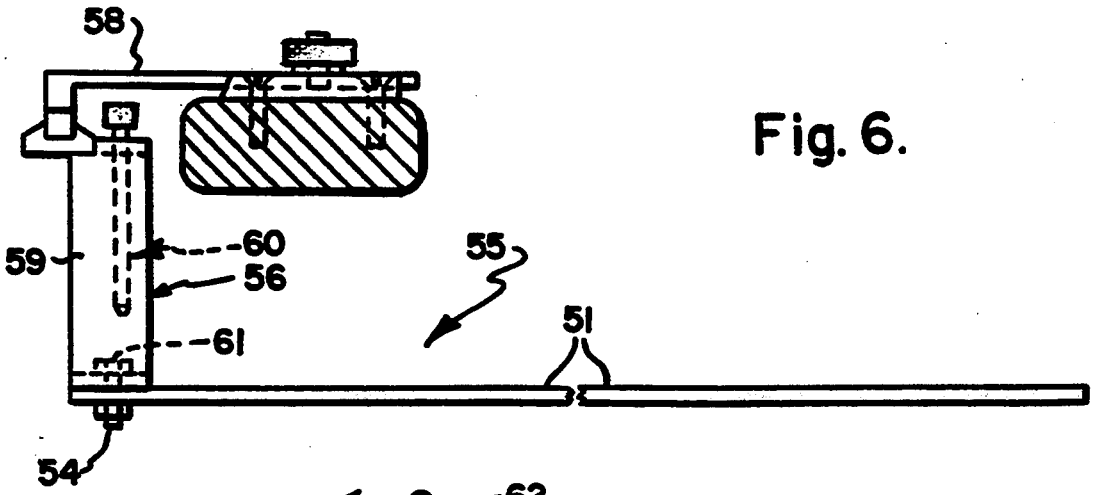
FIG. 6 is a fragmentary horizontal sectional view thereof, taken generally on line 6—6 of FIG. 5.

Second Embodiment (FIGS. 5–6)

The second embodiment of the improved eye shield, generally indicated at 55, is shown in FIGS. 5 and 6. Whereas the first embodiment shown in FIGS. 1–4 was mounted on a bar-type bow sight having a U-bolt, this second embodiment is mounted on a box-type bow sight, generally indicated at 56. This type of bow sight similarly includes a mounting plate 58 adapted to be secured to the bow, and a horizontally-elongated open-ended rectangular tube, 59 operatively mounted thereon, and supporting a number of sighting pins, severally indicated at 60.

In this case, however, plate 44 of the first embodiment may be eliminated altogether. A vertically elongated slot 61 may be provided in the box-type sight, and the shield member, again indicated at 51, may be operatively mounted thereon by fasteners, again indicated at 54.

Thus, whereas the first embodiment had a bar-type sight to which plate 44 was welded or otherwise secured, in the second embodiment, the sight itself is provided with slot 61, and eye shield 51 is mounted directly on the sight.

Figure 7:
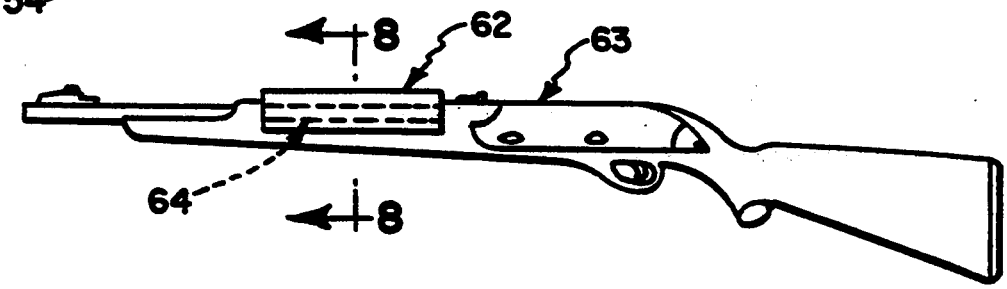
FIG. 7 is a view of another form of the improved eye shield mounted on a rifle.
Figure 8:
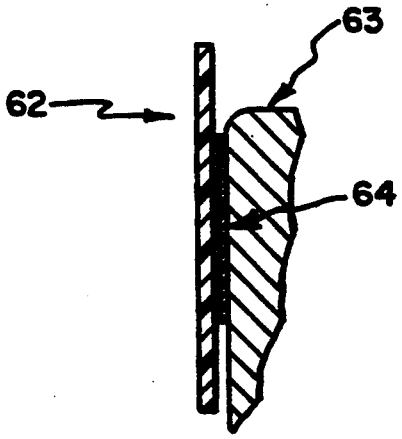
FIG. 8 is a fragmentary transverse vertical sectional view thereof, taken generally on line 8—8 of FIG. 7, showing the plate member in transverse cross-section.

Third Embodiment (FIGS. 7–8)

Referring now to FIG. 7, a third form of the improved eye shield, generally indicated at 62, is shown as being operatively mounted on a firearm, such as a rifle, generally indicated at 63. In this case, eye shield 62, which again is in the form of a horizontally-elongated vertically disposed rectangular plate having a length-to-height ratio of at least 5, is operatively mounted on a portion of rifle 63 by means of an adhesively-backed Velcro ®-type fastener, generally indicated at 64. As is well known in this art, Velcro ® is a type of hook-and-loop fastener. One portion (i.e., either the hook portion or the loop portion) is mounted on eye shield 62, while the other portion is mounted on rifle 63. Thus, eye shield 62 may be readily attached to, or removed from, rifle 63. Here again, the eye shield is so dimensioned, configured and arranged that, when operatively mounted on the rifle, it will, if projected rearwardly, intersect a person's head at a point between his eyes, thereby to limit the field of vision of each eye. This will facilitate the shooter in aiming and discharging his weapon with both eyes open.

Modifications

The present invention contemplates that many changes and modifications may be made. For example, the improved eye shield may be formed of any suitable material, such as a plastic, a metal or the like. The eye shield may be adjustably mounted on an existing bow sight, or may be attached to the weapon by some other dedicated means. In the preferred embodiment, the eye shield has a height of about 2 inches, and an overall length of about 12 inches, but this can readily be changed or modified as desired. While it is presently preferred that the eye shield be mounted on the bow or firearm so as to allow adjustability, other means for adjusting the vertical position of the eye shield might be alternatively employed. The invention may be readily mounted on other types of bows (e.g., recurve, etc.) and on pistols or handguns, as well as rifles.

Therefore, while several preferred forms of the improved eye shield have been shown and described, and several modifications thereof discussed, persons skilled in this art will readily appreciate that various additional changes and modifications may be made, without departing form the spirit of the invention, as defined and differentiated by the following claims.

I claim:

1. An eye shield attached to a bow for assisting a person in shooting an arrow from said bow with both eyes open, said eye shield comprising:

a member having a forward marginal end portion mounted on said bow and having a rearward marginal end portion extending toward the person's head when said person normally aims said bow, wherein said member, if imaginarily projected rearwardly, would intersect said person's head at a point between his eyes, said member being so dimensioned, proportioned and arranged as to limit the field of vision of said person's non-aiming eye;

whereby said eye shield will assist said person in shooting an arrow with both eyes open.

2. An eye shield as set forth in claim 1 wherein a sight is mounted on said bow, and wherein said forward marginal end portion of said member is mounted on said sight.

3. An eye shield as set forth in claim 2 wherein said sight includes a U-bolt, and said member is mounted on said U-bolt.

4. An eye shield as set forth in claim 3 wherein a first plate is mounted on said U-bolt, and extends rearwardly therefrom, and said member is mounted on said plate.

5. An eye shield as set forth in claim 4 wherein the vertical position of said member is adjustable with respect to said plate.

6. An eye shield as set forth in claim 1 wherein said plate is mounted for movement relative to said bow in a plane generally parallel to a plane passing through the draw string of said bow.

7. An eye shield as set forth in claim 1 wherein said bow has a draw string, and wherein said rearward marginal end portion of said member extends away from said bow and beyond said draw string when said bow is in an unflexed condition.

8. An eye shield as set forth in claim 1 and further comprising mounting means for mounting said member on said bow.

9. An eye shield as set forth in claim 8 wherein said mounting means includes a U-shaped member having a cross-bar and two parallel legs each terminating in distal marginal end portions, wherein said distal marginal end portions are secured to said bow, and wherein said member is mounted on said cross-bar.

10. An eye shield as set forth in claim 1 wherein said member is substantially plate-like and rectangular.

11. An eye shield as set forth in claim 10 wherein said member has a length-to-height ratio of at least five.

12. An eye shield as set forth in claim 1 wherein a box-type sight is mounted on said bow, and said member is mounted on said sight.

13. An eye shield as set forth in claim 12 wherein said the position of said member relative to said sight is adjustable.

* * * * *